US005762115A

United States Patent [19]

Shouse

[11] Patent Number: 5,762,115

[45] Date of Patent: Jun. 9, 1998

[54] DOOR TEMPLATE FOR USE WITH A DRILL AND A ROUTER

[76] Inventor: Gary A. Shouse, 10215 Frankfort Rd., Waddy, Ky. 40076

[21] Appl. No.: 806,064

[22] Filed: Feb. 25, 1997

[51] Int. Cl.[6] ..... B27F 5/12; B27G 17/18; B27C 5/00

[52] U.S. Cl. ..... 144/144.51; 33/197; 33/562; 144/27; 144/365; 408/241.6; 409/130

[58] Field of Search ..... 33/194, 197, 562, 33/563, 564; 144/27, 3.1, 144.1, 144.51, 365; 408/241.6, 704; 409/125, 130

[56] References Cited

U.S. PATENT DOCUMENTS

| | | | |
|---|---|---|---|
| 2,675,626 | 4/1954 | Boatwright | 33/197 |
| 3,184,859 | 5/1965 | Patrick | 144/27 |
| 3,519,043 | 7/1970 | Guill . | |
| 4,306,823 | 12/1981 | Nashlund | 33/197 |
| 4,479,523 | 10/1984 | Peterson et al. . | |
| 4,787,432 | 11/1988 | Williams | 33/562 |
| 4,914,822 | 4/1990 | Wetherington | 33/562 |
| 4,921,023 | 5/1990 | Pempek . | |
| 5,042,543 | 8/1991 | Carey . | |
| 5,062,460 | 11/1991 | Deline . | |
| 5,279,343 | 1/1994 | Woods . | |

*Primary Examiner*—W. Donald Bray
*Attorney, Agent, or Firm*—David W. Carrithers

[57] ABSTRACT

A door template provides a "T-shaped" plate arrangement for use in conjunction with a router and a drill to form mounting recesses for hardware, and more particularly for cutting a mortise for a hinge and a strike plate in a door and/or door jam. The door template is formed from a base template plate orthogonally connected to a guide plate for engaging a door surface. The guide plate of the door template extends outwardly normal to the surface of the base template plate so as form a "T-shaped" configuration. The guide plate separates the base template plate into a first straight edge portion and an opposing outer edge having a first cutaway section in the shape of a door hinge leaf pattern. Another pair of cutaway sections form a pair of corresponding pattern slots defining a first pattern slot opening, and a second pattern slot opening offset from the first pattern slot opening, extending through the straight edge side of the base template plate for forming latch plate patterns. The cutaway sections removed from the hinge plate and latch plate openings provide a templates for properly locating screw holes for the hinge and strike plate.

14 Claims, 2 Drawing Sheets

DOOR TEMPLATE FOR USE WITH A DRILL AND A ROUTER

BACKGROUND OF THE INVENTION

The present invention is directed to a template for properly locating recesses, and more particularly, to a template for locating recesses on the edge surface of a door or a door jam.

Most door hinges are set in recesses which are formed by a router. It is essential that the recesses in the door edge surface are correctly positioned and have the proper depth. Currently there are several templates for use in mounting doors in a door jamb. The known templates are complicated in design and often include adjustable features which include movable parts. These templates are relatively expensive to manufacture.

It is an object of the present invention to provide an inexpensive door template for use with a router and a drill.

It is another object of the invention to provide a door template having a guide structure for engaging a door and properly aligning openings in the template on a side edge surface of the door.

It is another object of the invention to provide a template which can be used with different size doors.

It is another object of the invention to provide a template assembly having cutout structures for locating drill holes and measuring the depth of a recess formed with a router.

SUMMARY OF THE INVENTION

The template of the present invention is designed to be used in conjunction with a router for properly locating mounting recesses for receiving a door hinge leaf or a latch plate for guiding a latch bolt which is operated by a door knob. The present invention achieves the above objects by providing a door template which is light, strong, inexpensive, and easy to use. The door template is used for cutting a mortise for a hinge and a strike plate in a door or jam. The present invention includes two pattern slots for doors 1 and ⅜ inches, and 1 and ⅞ inches thick. The hinge slot is designed for a 3 and ½ inch thick residential door with a ⅝ inch radius, which can be positioned to accommodate a larger hinge. The door template comes with three inserts for locating drill holes for the screws used to hold the hinge and strike plate.

The template may be integrally molded from a transparent plastic material or it may be constructed in two pieces which are then mechanically attached with screws or the like. Other materials, such as wood or metal, preferably aluminum, can be used in constructing the template.

More particularly, the template of the present invention is formed with a guide plate which is designed to engage one of the side surfaces of a door for properly locating and aligning an aperture corresponding to a mounting recess. The guide plate extends perpendicularly from the lower surface of a template plate so that when the guide plate engages the appropriate surface of the door, the desired aperture will be precisely vertically aligned relative to the door edge surface.

Apertures are provided in the template on either side of the guide plate. Two apertures corresponding to latch plate mounting recesses are formed in the template plate. The two apertures have longitudinal axes which are offset so that one hole corresponds to a 1⅛ inch door and the other hole corresponds to a 1¾ inch door. A larger open-sided aperture or opening, corresponding to a hinge leaf mounting recess, is formed in a side edge of the template plate. The open sided aperture is located so that the guide plate extends between the two apertures and the larger open-sided aperture on a lower surface of the template plate.

It is also contemplated that the cutout structures, created when forming the openings, could be provided with through holes and used to locate the drill holes for the latch plate and hinge leaf fasteners. Indicia can be provided on edge surfaces of the cutout structures or on internal peripheral surfaces of the openings for indicating the depth of the recesses formed with a router.

Thus the door template provides a "T-shaped" plate arrangement for use in conjunction with a router and a drill to form mounting recesses for hardware, and more particularly for cutting a mortise for a hinge and a strike plate in a door and/or door jam. The door template is formed from a base template plate orthogonally connected to a guide plate for engaging a door surface. The guide plate of the door template extends outwardly normal to the surface of the base template plate so as form a "T-shaped" configuration. The guide plate separates the base template plate into a first straight edge portion and an opposing outer edge having a first cutaway section in the shape of a door hinge leaf pattern. Another pair of cutaway sections form a pair of corresponding pattern slots defining a first pattern slot opening, and a second pattern slot opening offset from the first pattern slot opening, extending through the straight edge side of the base template plate for forming latch plate patterns. The cutaway sections removed from the hinge plate and latch plate openings provide a templates for properly locating screw holes for the hinge and strike plate.

The preferred embodiment of the door template assembly for use with a router and a drill consists of a template plate having first and second planar surfaces. A guide plate is connected to a base template plate so as form a T-shaped configuration, wherein the guide plate forms a leg of the T-shaped configuration and the template plate forms a top of the T-shaped configuration. A first latch plate opening is provided in the template plate. A second latch plate opening, offset from said first opening is also provided in the template plate. A third hinge leaf opening is formed in a peripheral edge of the template plate. A plurality of cutout structures are formed which correspond the openings.

DETAILED DESCRIPTION OF THE INVENTION

Figure 1:
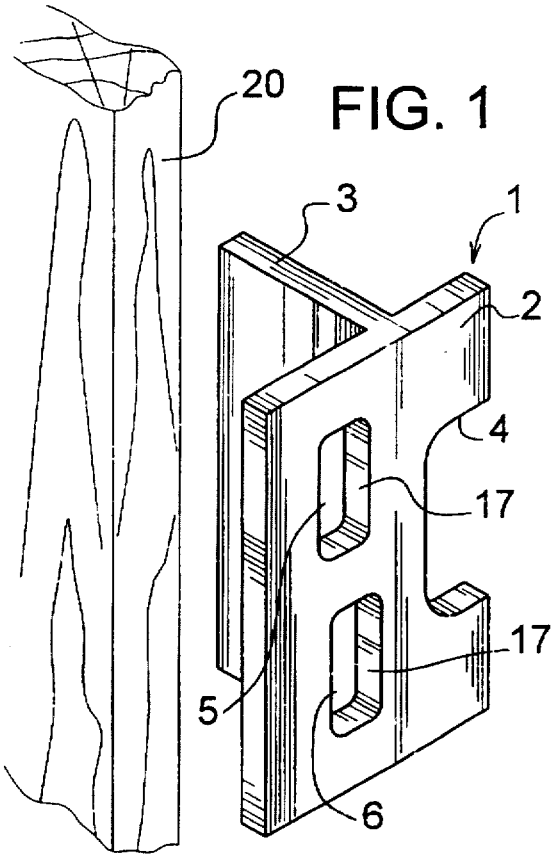
FIG. 1 is a front perspective view of a template shown adjacent a door edge surface.

The present invention will now be described with reference to the drawing figures. The door template is generally referenced by the numeral 1. Wood, metal, and preferably plastic may be used in constructing the template 1 which may integrally molded in one piece or formed from two separate pieces connected together.

The door template 1 of the preferred embodiment is formed of two plates connected normal to one another in a T-shaped configuration. As illustrated in FIG. 1, the door template 1 includes a base template plate 2 and a guide plate 3 which extends orthogonally from a lower surface of the base template plate 2.

Figure 9:
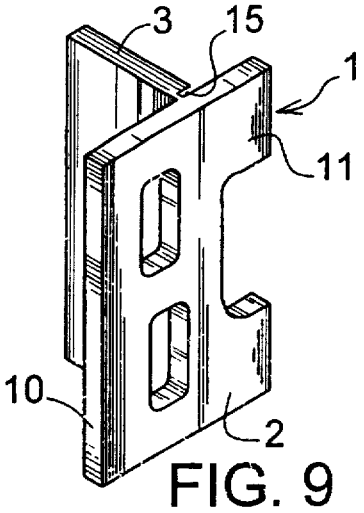
FIG. 9 is a front perspective view of an alternate embodiment of the present invention showing a space forming a groove at the joining of the guide plate with the template plate allowing for folding of the guide plate flat against the template plate for storage.

FIG. 9 shows an alternate embodiment of the door template 1, wherein the guide plate 3 is hingedly connected to the base template plate 2 by hinging means, such as one or more leaf hinges or by a living hinge having a flexible joint which may be formed during molding of a polymer material such as is shown in FIG. 9. The hinged door template 1 may be formed by forming a space or groove 15 at the joining of the guide plate 3 with the template plate 2 during molding allowing for folding of the guide 3 plate flat against the template plate 2 for storage.

The preferred embodiment of the base template plate 2 as shown in FIGS. 1–8 forms a rectangular plate. The base template plate 2 defines a straightedge section 10 and includes specific shapes removed or cutout in order to form an opposing template cutaway section 11 defining an opening 4 in the general shape of a hinge leaf in the side edge of the base template plate 2. Elongated holes, openings, or latch plate slots 5, 6 are formed in the portion of the base template plate 2 on the side of the guide plate 3 opposite the template cutaway section 11.

Figure 2:
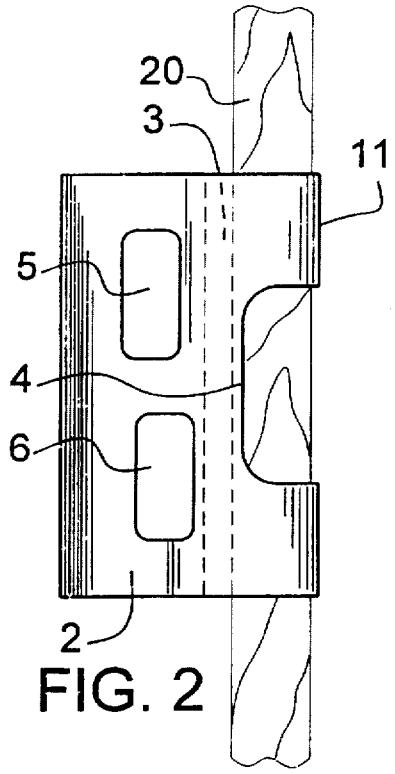
FIG. 2 is a front view of the template shown in a position for locating a hinge mounting recess on the door edge surface.
Figure 4:
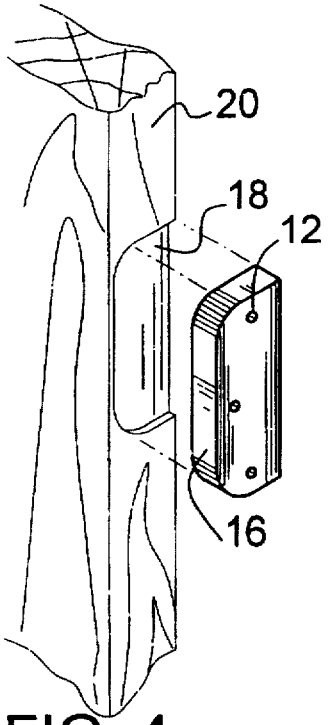
FIG. 4 is a perspective view showing a cutout structure which corresponds to a hinge mounting recess.
Figure 5:
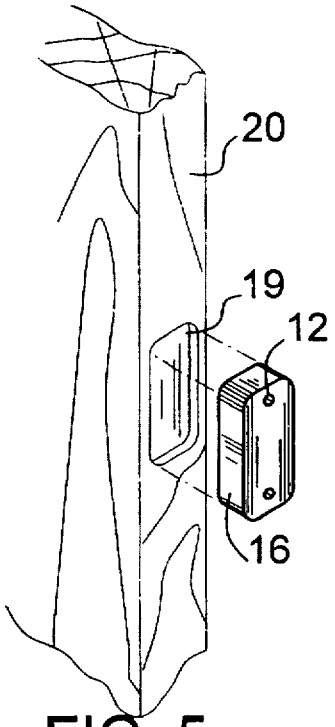
FIG. 5 is a perspective view showing a cutout structure which corresponds to a latch plate mounting recess.

As shown best in FIG. 2, the opening 4 corresponds to shape of a hinge leaf. The opening 4 is used to locate a recess 18 (FIG. 4) for receiving and mounting a hinge leaf on a side edge surface of a door 20 or jam. The door template 1 can also be positioned to accommodate a larger "wider" hinge leaf.

Figure 3:
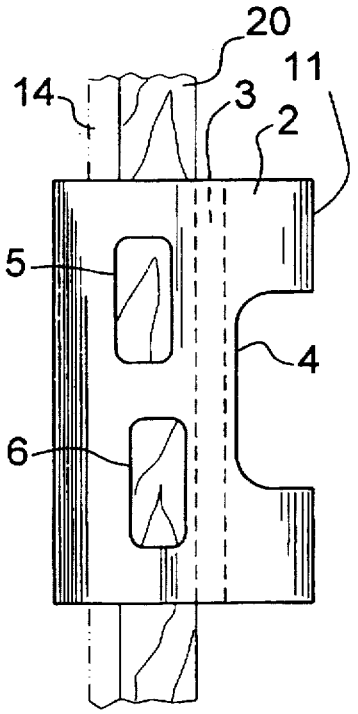
FIG. 3 is a front view of the template shown in a position for forming a latch plate mounting recess.

As shown in FIG. 3, the openings 5, 6 correspond to the shape of a latch plate. The openings 5, 6 are used to locate a recess 19 (FIG. 5) in the side edge surface of the door 20. Note that the first opening 5 has a longitudinal axis which is parallel to or offset relative to the longitudinal axis of the second opening 6. This arrangement allows the door template 1 to be used with either a 1⅛ inch thick door or a 1¾ inch thick door; however it is contemplated that the slots can also be cut to accommodate a 1⅞ inch thick door. With the door 20 shown in FIG. 3, the lower opening 6 is used to located the mounting recess. The phantom line 14 indicates the larger size door which would require the use of the upper first opening 5.

The material that is removed to form openings 4, 5, 6 in the base template plate 2 can constitute cutout structures 7, 8, 9 respectively. Alternatively, the cutout structures 7, 8, 9 can be formed separately, and simply correspond in size and shape to the openings 4, 5, 6; wherein the cutout structure 7 is for a hinge leaf, and cutout structures 8 and 9 are for latch plates. The language "cutout structure" is intended to refer to both structures which are actually "cutout" from the base template plate 2, as well as structures which are separately formed.

Figure 6:
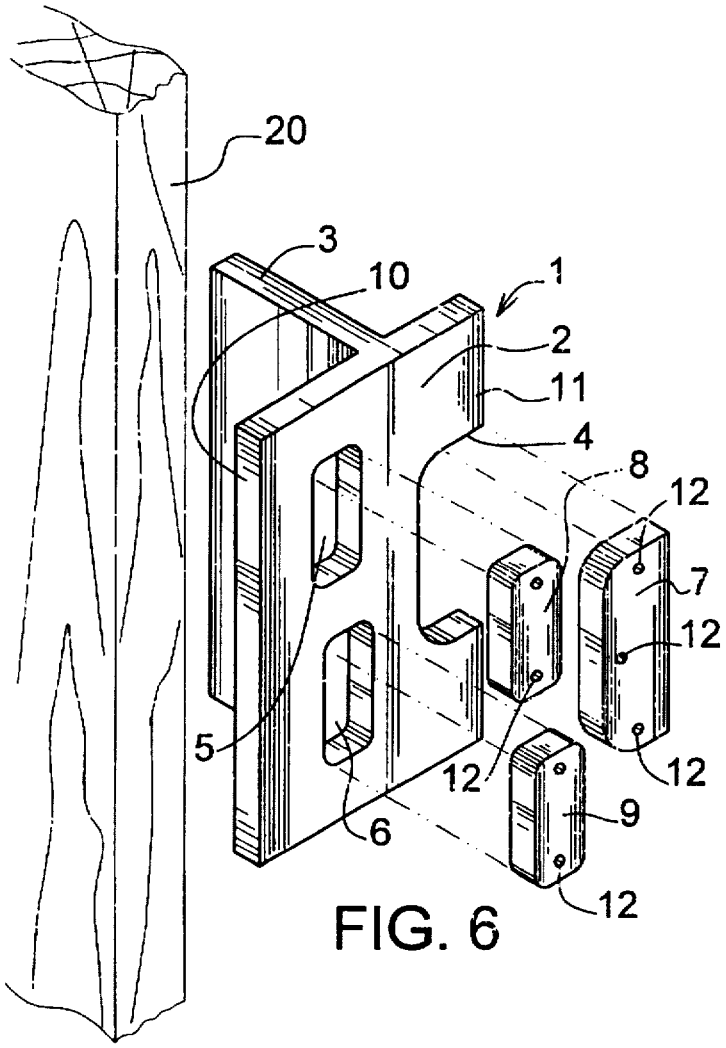
FIG. 6 is a front perspective view, similar to the view shown in FIG. 1, showing the cutout structures and their relationship with the template.

FIG. 6 illustrates the entire door template 1 assembly and the correspondence between the openings 4, 5, 6 and the cutout structures 7, 8, 9. Each of the cutout structures has a plurality of through holes 12. The through holes 12 are used to draw patterns or to provide guides to locate drill holes for receiving fasteners such as screws and the like.

Figure 7:
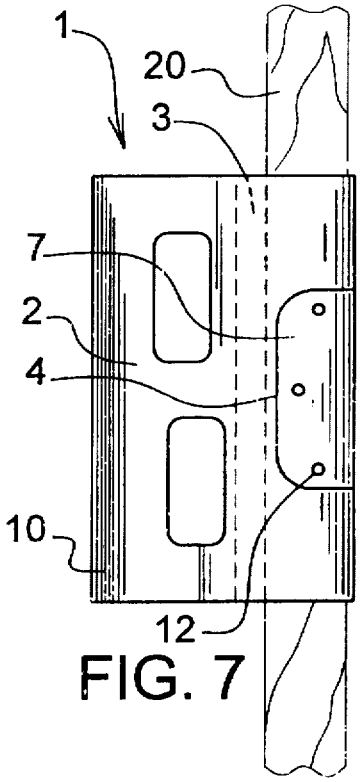
FIG. 7 is a front view, similar to FIG. 2, showing one of the cutout structures engaged in an opening in the template for locating the hinge mounting recess.
Figure 8:
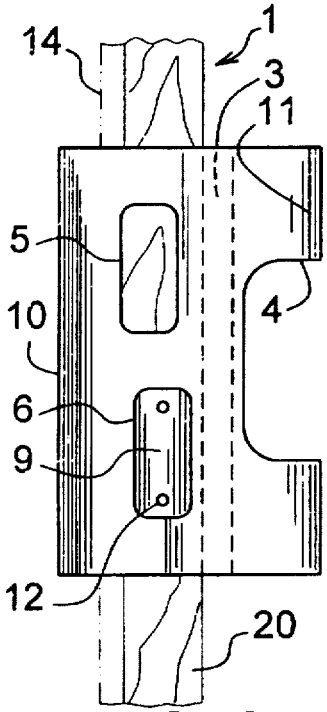
FIG. 8 is a front view, similar to FIG. 3, showing one of the cutout structures engaged in an opening in the template for locating the latch plate mounting recess.

The cutout structures each may include indicia 16 on their side edges for indicating the depth of a recess formed by a router. For example, the depth of the recess 18 should be approximately equal to the thickness of the hinge leaf so that when mounted the top surface of the hinge leaf will be flush with the edge surface of the door 20. Alternatively, indicia 17 may provided on the internal peripheral surfaces of the openings 4, 5, 6. With this arrangement, as shown in FIGS. 7 and 8, the depth of a recess can be checked by inserting the appropriate cutout structure into the opening and comparing the position of the top exposed surface of the cutout relative to the indicia 17 provided on the internal peripheral surface of the opening.

The door template 1 is easy to use. First, depending upon the desired recess, the guide plate 3 is positioned against one of the major sides of the door 20. As shown in FIG. 2, the guide plate 3, shown in phantom, is placed against the left side of the door 20 and the base template plate 2 is placed against the door edge surface. In this manner the hinge leaf opening 4 is precisely vertically aligned on the door edge surface and the hinge mounting recess 18 can now be formed with a router. Note that the depth of opening 4 is sufficient to accommodate either a 1⅛ inch door or a 1¾ inch door. After the recess is formed, the hinge leaf cutout structure 7 is inserted into the opening 4 (FIG. 7) to check the depth of the recess and to locate the drill holes. After holes are drilled in the door edge surface, the hinge leaf can be placed in the recess and secured with screws.

As best illustrated in FIG. 3, the guide plate 3, shown in phantom, is placed against the right side of the door 20 and the base template plate 2 is placed against the door edge surface. In this case, the lower latch plate opening 6 is now centered and vertically aligned on the door edge surface and the latch plate mounting recess 19 can now be formed with a router. Of course if a thicker door were being used, the upper opening 5 would have been used to locate the recess 19. After the recess 19 is formed, one of the cutout structures such as shown in FIG. 8, is inserted into the latch plate opening 5 to check the depth of the recess and to locate the drill holes. After holes are drilled in the door edge surface, the latch plate can be placed in the recess 19 and secured with screws.

While particular embodiments of the invention have been shown and described, it should be understood that the invention is not limited thereto, since many modifications are possible within the scope of the appended claims. The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A door template structure comprising:

a template plate;

a first opening provided in said template plate;

a second opening, offset from said first opening, provided in said template plate;

a third opening formed in a peripheral edge of said template plate; and a guide plate connected to said template plate so as form a T-shaped configuration, wherein said guide plate forms a leg of said T-shaped configuration and said template plate forms a top of said T-shaped configuration.

2. The door template as claimed in claim 1, wherein each of said openings include indicia on an inner peripheral surface thereof.

3. The door template as claimed in claim 1, wherein a surface of said guide plate lies in a plane which is perpendicular to said planar surfaces of said template plate, and each of said first and second openings is an elongated opening having a longitudinal axis which is parallel to said plane.

4. The door template as claimed in claim 3, wherein said longitudinal axes of said first and second openings are laterally offset.

5. A door template assembly for use with a router and a drill, said template comprising:

a template plate having first and second planar surfaces;

a first opening provided in said template plate;

a second opening, offset from said first opening, provided in said template plate;

a third opening formed in a peripheral edge of said template plate;

a plurality of cutout structures corresponding to said openings; and a guide plate connected to said template plate so as form a T-shaped configuration, wherein said guide plate forms a leg of said T-shaped configuration and said template plate forms a top of said T-shaped configuration.

6. The template assembly as claimed in claim 5, wherein said guide plate extends across one of said planar surfaces of said template plate between said first opening and said third opening.

7. The template assembly as claimed in claim 5, wherein a surface of said guide plate lies in a plane which is perpendicular to said planar surfaces of said template plate, and each of said first and second openings is an elongated opening having a longitudinal axis which is parallel to said plane.

8. The template assembly as claimed in claim 5, further comprising indicia provided on an interior peripheral surface of said openings.

9. The template assembly as claimed in claim 8, wherein each of said first and second openings have a longitudinal axis and said longitudinal axis of said first opening is parallel to said longitudinal axis of said second opening.

10. The template assembly as claimed in claim 5, wherein said plurality of cutout structures comprise:

a first cutout structure corresponding to said first cutout and having a plurality of through holes for locating drill holes;

a second cutout structure corresponding to said second cutout aperture and having a plurality of through holes for locating drill holes; and a third cutout structure corresponding to said opening and having a plurality of through holes for locating drill holes.

11. The door template as claimed in claim 1, wherein said guide plate is hingedly connected to said template plate so that said guide plate lies flat against said template plate during storage.

12. The door template as claimed in claim 11, wherein said guide plate is hingedly connected to said template plate by a living hinge.

13. The door template as claimed in claim 5, wherein said guide plate is hingedly connected to said template plate so that said guide plate lies flat against said template plate during storage.

14. The door template as claimed in claim 13, wherein said guide plate is hingedly connected to said template plate by a living hinge.

* * * * *